US008398504B2

(12) United States Patent
Iwade et al.

(10) Patent No.: US 8,398,504 B2
(45) **Date of Patent: *Mar. 19, 2013**

(54) SHAFT SELECTION ASSIST APPARATUS

(75) Inventors: Hirotada Iwade, Chichibu (JP); Fumiaki Sato, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 57 days.

This patent is subject to a terminal disclaimer.

(21) Appl. No.: 12/971,644

(22) Filed: Dec. 17, 2010

(65) Prior Publication Data

US 2011/0159979 A1 Jun. 30, 2011

(30) Foreign Application Priority Data

Dec. 25, 2009 (JP) ..... 2009-293805

(51) Int. Cl.
*A63B 53/00* (2006.01)
*A63B 57/00* (2006.01)
*A63F 9/24* (2006.01)

(52) U.S. Cl. ..... 473/289; 473/199; 473/316; 473/409; 463/47

(58) Field of Classification Search ..... 463/47; 473/131, 199, 202, 316, 409
See application file for complete search history.

(56) References Cited

U.S. PATENT DOCUMENTS 6,702,692 B1 * 3/2004 Smith ..... 473/289
6,719,648 B1 * 4/2004 Smith ..... 473/409
6,966,843 B2 * 11/2005 Rankin et al. ..... 473/202
7,153,215 B2 * 12/2006 Peterson et al. ..... 473/199
2004/0127303 A1 7/2004 Teraoka
2005/0277483 A1 * 12/2005 Peterson et al. ..... 473/282
2009/0247312 A1 * 10/2009 Sato et al. ..... 473/223

FOREIGN PATENT DOCUMENTS

JP 2003-102892 A 4/2003
JP 2009-178296 A 8/2009

* cited by examiner

*Primary Examiner* — David L Lewis
*Assistant Examiner* — Robert Mosser
(74) *Attorney, Agent, or Firm* — Sughrue Mion, PLLC

(57) ABSTRACT

A shaft selection assist apparatus according to this invention includes a storage means for storing recommended shaft information indicating a correspondence between measurement parameters obtained upon a test strike with a golf club to which a predetermined reference shaft is attached, and recommended shafts among shafts of a plurality of types, an acquisition means for acquiring the measurement results of the measurement parameters associated with a test strike actually made by a user with the golf club, a selection means for selecting a recommended shaft by referring to the recommended shaft information based on the measurement results acquired by the acquisition means, and an output means for outputting information indicating the recommended shaft selected by the selection means. The measurement parameters include the vertical launch angle of a struck ball and the back spin amount on the struck ball. The recommended shaft information stored in the storage means is information which specifies recommended shafts based on the relationship between the shaft rigidity distribution, and the vertical launch angle and the back spin amount.

4 Claims, 8 Drawing Sheets

| FLEX | RIGIDITY DISTRIBUTION GROUP | | | |
|---|---|---|---|---|
| | I | II | III | IV |
| X | Astro75 | EW-7 | 7F09 | 7Y07 |
| | TDR-70 | ASD9003 | Ka70 | 7V08 |
| | | | DiaD73 | |
| S | Astro65 | EW-6 | Lisre63 | 6Y07 |
| | BB03W | BB01W | 6F09 | 6V08 |
| | Y60 | | | DiaD63 |
| R | Astro55 | EW-5 | BararaH53 | 5Y07 |
| | TourB08 | MC-5 | N55 | 5V08 |
| | | | | |

| FLEX | RIGIDITY DISTRIBUTION GROUP | | | | |
|---|---|---|---|---|---|
| | I | II | III | IV | V |
| X | Astro75 | EW-7 | 7F09 | 7Y07 | MC-7 |
| | TDR-70 | ASD9003 | Ka70 | 7V08 | DiaS73 |
| | | | DiaD73 | | |
| S | Astro65 | EW-6 | Lisre63 | 6Y07 | MC-6 |
| | BB03W | BB01W | 6F09 | 6V08 | Ka60 |
| | Y60 | | | DiaD63 | DiaS63 |
| R | Astro55 | EW-5 | BararaH53 | 5Y07 | BararaF53 |
| | TourB08 | MC-5 | N55 | 5V08 | CD-50 |
| | | | | | |

SHAFT SELECTION ASSIST APPARATUS

BACKGROUND OF THE INVENTION

1. Field of the Invention

The present invention relates to an apparatus that assists in selecting a shaft for a golf club.

2. Description of the Related Art

In recent years, a tendency among golfers to want golf clubs more suitable for them is growing. Hence, a method of measuring the head speed and struck ball data upon a test strike, and selecting a golf club in accordance with the measurement results (for example, Japanese Patent Laid-Open No. 2003-102892), etc. have been proposed. A tendency to want parts of a golf club, which are individually, exclusively suitable for each golfer, is also growing, and many golfers want especially shafts suitable for them. Hence, a golf club with an easily exchangeable shaft (for example, Japanese Patent Laid-Open No. 2009-178296), etc. have also been proposed.

A wide variety of shafts have been distributed to the market, so it is becoming important for golf shops to carefully select and recommend shafts suitable for individual golfers. In the conventional recommended shaft selection, it is often the case that shafts are classified mainly in accordance with their flexes (stiffnesses), and shafts with flexes corresponding to individual golfers are selected and recommended in consideration of, for example, their head speeds. However, even shafts with nearly the same flex may give greatly different swing feels and produce greatly different test strike results, so a new method of selecting a recommended shaft is required.

SUMMARY OF THE INVENTION

It is an object of the present invention to select shafts suitable for individual golfers.

According to an aspect of the present invention, there is provided a shaft selection assist apparatus comprising storage means for storing recommended shaft information indicating a correspondence between measurement parameters obtained upon a test strike with a golf club to which a predetermined reference shaft is attached, and recommended shafts among shafts of a plurality of types, acquisition means for acquiring measurement results of the measurement parameters associated with a test strike actually made by a user with the golf club, selection means for selecting a recommended shaft by referring to the recommended shaft information based on the measurement results acquired by the acquisition means, and output means for outputting information indicating the recommended shaft selected by the selection means, wherein the measurement parameters include a vertical launch angle of a struck ball and a back spin amount on the struck ball, and the recommended shaft information stored in the storage means comprises information which specifies recommended shafts based on a relationship between a shaft rigidity distribution, and the vertical launch angle and the back spin amount.

Further features of the present invention will become apparent from the following description of exemplary embodiments with reference to the attached drawings.

DESCRIPTION OF THE EMBODIMENTS

First Embodiment

<Apparatus Arrangement>

Figure 1:
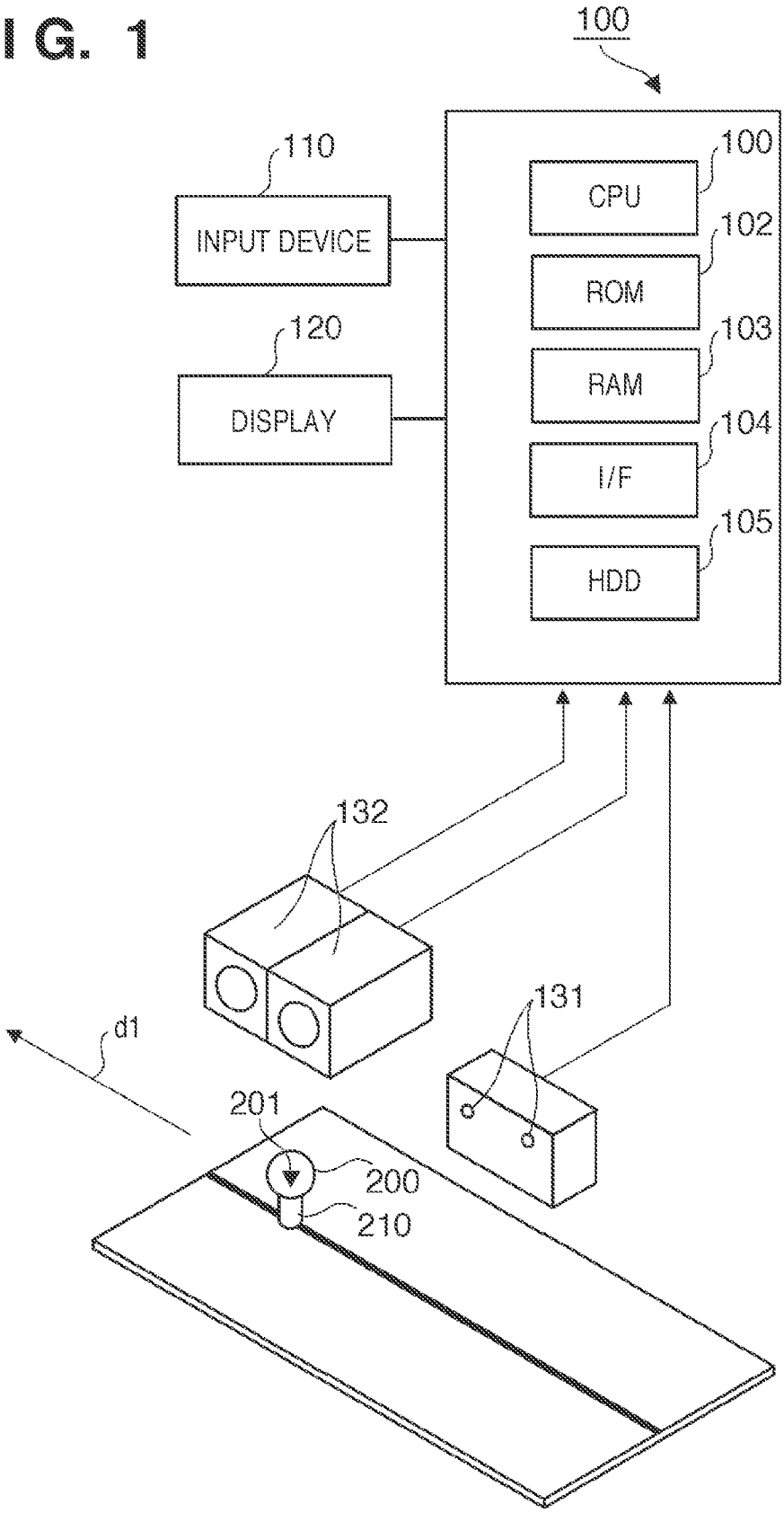
FIG. 1 is a block diagram of a test strike system using a shaft selection assist apparatus 100 according to an embodiment of the present invention.

FIG. 1 is a block diagram of a test strike system using a shaft selection assist apparatus 100 (to be simply referred to as the assist apparatus 100 hereinafter) according to an embodiment of the present invention. The assist apparatus 100 includes a CPU 101, ROM 102, RAM 103, interface 104, and HDD (Hard Disk Drive) 105, and can be formed using a general computer.

The CPU 101 executes a program associated with shaft selection assistance (to be described later). This program is stored in the HDD 105. Also, the HDD 105 accumulates data necessary to execute this program, such as recommended shaft information and individual shaft information (to be described later). Each of the ROM 102, RAM 103, and HDD 105 may be a storage means of another type.

The interface 104 is interposed between an external device and the CPU 101 to allow the CPU 101 to output data to an external device and allow the external device to input data to the CPU 101. Interfaces 104 suitable for individual external devices can be provided.

An input device 110 includes, for example, a keyboard and a pointing device such as a mouse. The CPU 101 can acquire information and an instruction, which are input to the input device 110, via the interface 104. A display 120 displays various kinds of information as electronic images in accordance with instructions from the CPU 101. The CPU 101 performs, for example, display control of the recommended shaft selection result via the interface 104.

The assist apparatus 100 according to this embodiment is connected to a measuring device for measuring various kinds of measurement parameters upon a test strike. In this embodiment, the measuring device includes a pair of sensors 131 and a pair of cameras 132. A test strike is made by actually striking a golf ball 200, supported on a tee 210, assuming a direction d1 indicated by an arrow as the flight trajectory direction (target direction). A mark 201 for measuring data on a struck ball is formed on the surface of the golf ball 200.

The sensor 131 is a photosensor including, for example, a light-emitting element and light-receiving element. The pair of sensors 131 are arranged slightly behind the tee 210 in the direction d1 with a spacing from the tee 210 in a direction perpendicular to the direction d1, and are spaced apart from each other in a direction parallel to the direction d1. Each of the pair of sensors 131 detects passage of a golf club head.

The pair of cameras 132 are arranged slightly in front of the tee 210 in the direction d1 with a spacing from the tee 210 in a direction perpendicular to the direction d1, and are spaced apart from each other in a direction parallel to the direction d1. Each of the pair of cameras 132 captures an image of a struck ball (golf ball 200).

Data on the detection result obtained by the sensor 131 and on the image captured by the camera 132 are read into the assist apparatus 100. The CPU 101 measures the time from when the sensor 131 on the rear side in the direction d1 detects passage of a golf club head until the sensor 131 on the front side in this direction detects passage of the golf club head. The CPU 101 can then calculate the head speed from the measured time and the known distance between the pair of sensors 131.

Figure 2:
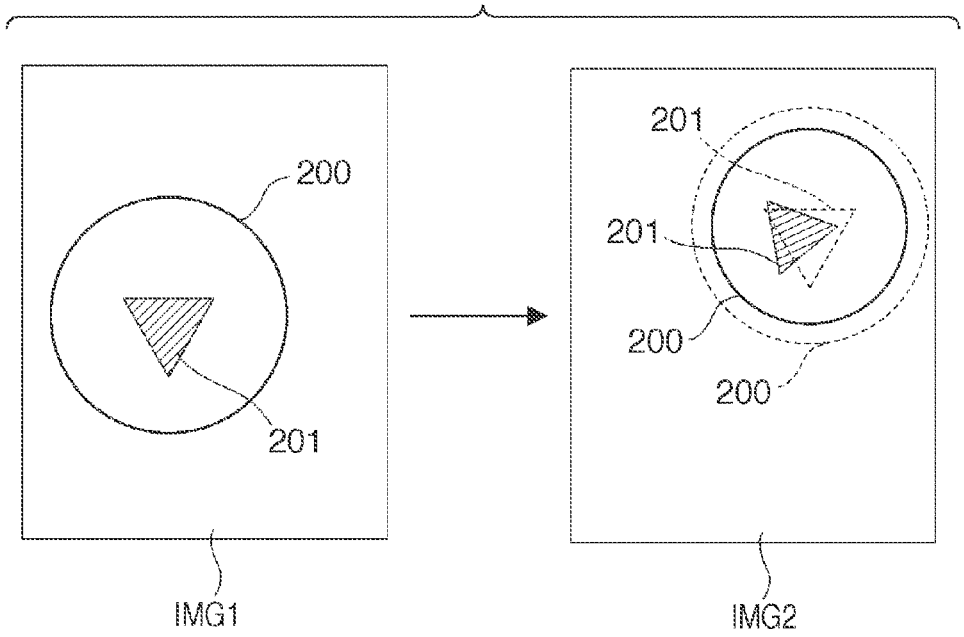
FIG. 2 is a view showing an example of images captured by cameras 132.

The CPU 101 can also calculate the back spin amount on a struck ball, the side spin amount and side spin direction on this ball, and the vertical and horizontal launch angles of this ball based on the images captured by the pair of cameras 132. These values can be calculated based on changes in position and orientation of the mark 201 included in the captured images, the image capturing timings, and the distances between the pair of cameras 132. FIG. 2 is a view showing an example of the images captured by the cameras 132, in which IMG1 exemplifies the image captured by the camera 132 on the rear side in the direction d1, and IMG2 exemplifies the image captured by the camera 132 on the front side in this direction. In the image IMG2, a ball 200 and mark 201 indicated by broken lines correspond to the ball 200 and mark 201, respectively, captured in the image IMG1.

The back spin amount can be calculated from the amount of vertical pivoting, the side spin amount and direction can be calculated from the amount of horizontal displacement of the mark 201, and the vertical launch angle can be calculated from the amount of vertical displacement of the mark 201. The horizontal launch angle can be calculated from a change in size of the mark 201. As shown in the image IMG2, when the mark 201 is smaller than that in the image IMG1, the ball 200 is launched horizontally, so the launch angle can be calculated based on the degree of horizontal launch.

<Shaft Rigidity Distribution>

Figure 3:
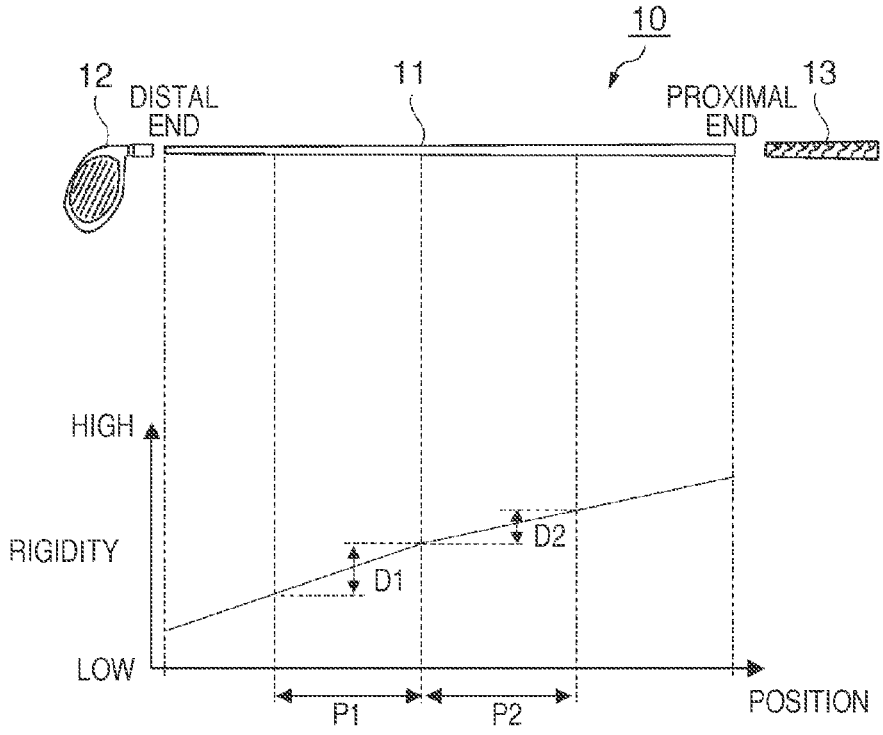
FIG. 3 shows an exploded perspective view of a golf club 10 and a graph for explaining its rigidity distribution.

In this embodiment, a plurality of shafts are classified based on their rigidity distributions, and a recommended shaft is selected from them. First, the shaft rigidity distribution will be described. FIG. 3 shows an exploded perspective view of a golf club 10 and a graph for explaining its rigidity distribution. The golf club 10 includes a shaft 11, head 12, and grip 13. Although the head 12 is of the wood type in FIG. 3, it may be of the iron type.

In the shaft 11, the side of the head 12 will be called a distal end, and the grip 13 will be called a proximal end. Normally, the shaft 11 has a rigidity (Young's Modulus×Cross-sectional Second-order Moment) which gradually increases from the distal end to the proximal end. However, the rigidity of the shaft 11 does not always increase linearly, and increases with characteristics which differ depending on its type.

The present invention focuses attention on the fact that the shaft rigidity distribution influences a swing and a struck ball. In this embodiment, shafts are classified especially based on the distal rigidity difference and proximal rigidity difference among various types of shaft rigidity distributions, and a recommended shaft is selected.

The distal rigidity difference means the rigidity difference in a predetermined range of the shaft on the distal side, and corresponds to a rigidity difference D1 between the two ends of a range P1 in FIG. 3. The proximal rigidity difference means the rigidity difference in a predetermined range of the shaft on the proximal side, and corresponds to a rigidity difference D2 between the two ends of a range P2 in FIG. 3. The range of a predetermined length (for example, 250 mm) toward the distal end from the middle of the shaft as a boundary, for example, can be determined as the range P1, and that of the predetermined length toward the proximal end from this middle, for example, can be determined as the range P2. Note that the ranges P1 and P2 need not always be continuous with each other, unlike the example shown in FIG. 3, and may be separated from each other as long as they are on the distal and proximal sides, respectively, with respect to the middle of the shaft as a boundary.

The inventors of the present invention conducted an experiment, and concluded that the golfer is likely to feel that the distal end of the shaft is soft during a swing when the distal rigidity difference is large, whereas he or she is likely to feel that the distal end of the shaft is stiff during a swing when the distal rigidity difference is small. Also, we concluded that the golfer is likely to feel that the proximal end of the shaft is stiff during a swing when the proximal rigidity difference is large, whereas he or she is likely to feel that the proximal end of the shaft is soft during a swing when the proximal rigidity difference is small. Hence, a shaft suitable for the tendency of a swing or struck ball for the golfer can be recommended to him or her in consideration of such shaft rigidity distributions.

<Shaft Classification>

Figures 4A, 4B:
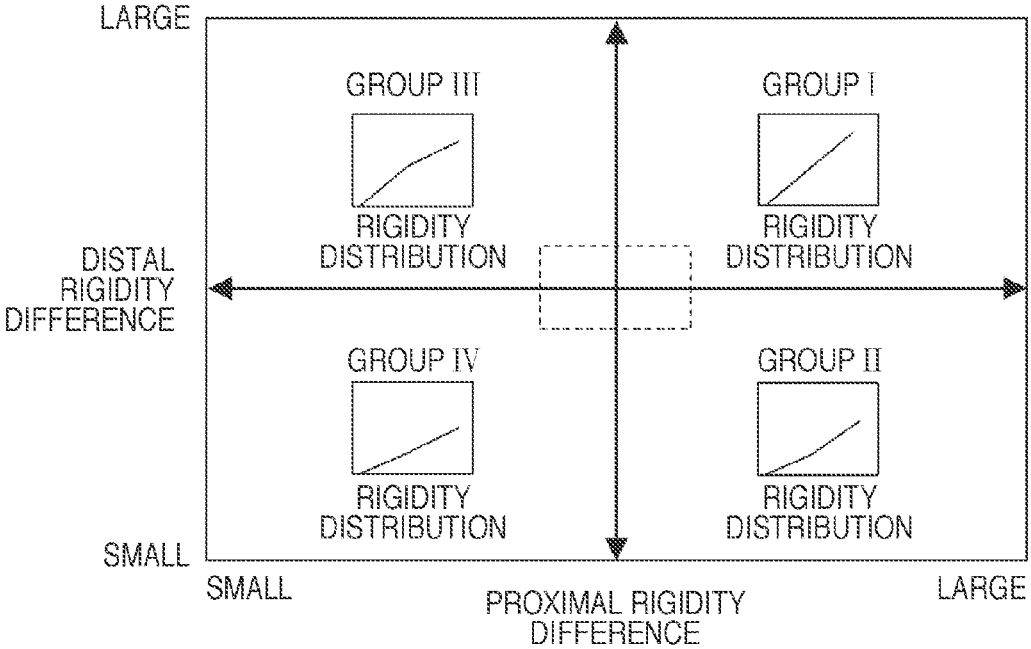
FIG. 4A is a diagram for explaining groups I to IV.
FIG. 4B is a table showing an example of the types of shafts in each group.

In this embodiment, shafts are classified into four groups I to IV in accordance with the distal rigidity difference and proximal rigidity difference. FIG. 4A is a diagram for explaining groups I to IV. Group I includes shafts with both relatively large distal rigidity differences and proximal rigidity differences. Group II includes shafts with relatively small distal rigidity differences and relatively large proximal rigidity differences. Group III includes shafts with relatively large distal rigidity differences and relatively small proximal rigidity differences. Group IV includes shafts with both relatively small distal rigidity differences and proximal rigidity differences. The distal rigidity difference can be determined relatively large or small using a rigidity value of, for example, 0.9 to 1.3 as a boundary, and the proximal rigidity difference can be determined relatively large or small using a rigidity value of, for example, 1.1 to 1.3 as a boundary. Although four groups I to IV are set in accordance with the shaft rigidity distributions in this embodiment, three or less or five or more groups can also be set.

FIG. 4B shows an example of shaft classification. In the example shown in FIG. 4B, shafts are classified into groups I to IV and further classified in accordance with their flexes (three levels X, S, and R). Although each of groups I to IV need only include a shaft of at least one type, it preferably includes shafts of a plurality of types, as in the example shown in FIG. 4B. Also, a shaft of at least one type preferably belongs to each shaft flex, and shafts of a plurality of types more preferably belong to each shaft flex, as in the example shown in FIG. 4B. The shaft classification information shown in FIG. 4B is stored in the HDD 105.

<Test Strike>

In recommended shaft selection, the user actually makes a test strike using a golf club to which a predetermined reference shaft is attached, and the measurement results of specific measurement parameters are used. In this embodiment, the head speed, the side spin amount and direction on a struck ball, and the horizontal launch angle of this ball are used to select a recommended shaft. The CPU 101 of the assist apparatus 100 reads the detection results obtained by the pair of sensors 131, and the images captured by the pair of cameras 132, calculates the measurement result of each measurement parameter, and stores them in the HDD 105. The measurement result of each measurement parameter preferably is its average obtained upon a plurality of times of test strikes.

The reference shaft for use in a test strike desirably has a rigidity distribution with little unevenness, such as the one which belongs to a region surrounded by a broken line in FIG. 4A, that is, the one which has nearly the average distal rigidity difference and proximal rigidity difference. More specifically, a rigidity distribution with a distal rigidity difference of about 1.14 and a proximal rigidity difference of about 1.23 is desirable.

<Shaft Selection Assist Process>

Figure 5A:
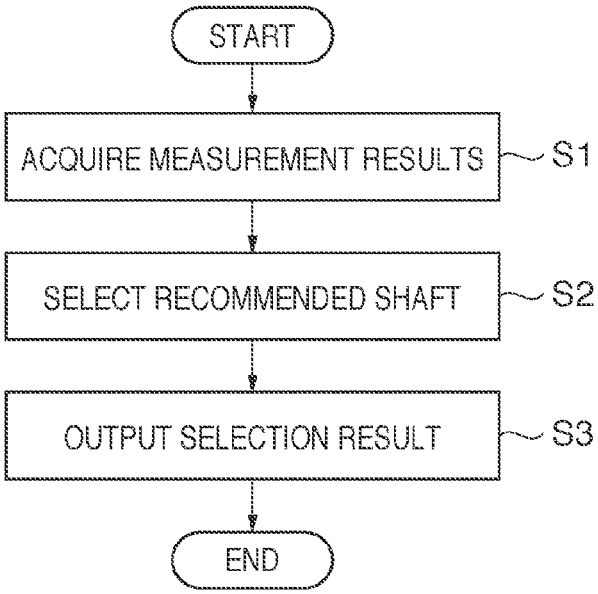
FIG. 5A is a flowchart showing an example of a selection assist process executed by a CPU 101.

A shaft selection assist process executed by the CPU 101 of the assist apparatus 100 will be described next with reference to FIG. 5A. FIG. 5A is a flowchart showing an example of a selection assist process executed by the CPU 101.

In step S1, the measurement results of measurement parameters obtained upon a test strike are acquired. In this embodiment, the measurement results obtained upon a test strike are stored in the HDD 105. Thus, the measurement results are acquired by reading them out from the HDD 105. Assume that although the user made a test strike in the past, the measurement results obtained upon the test strike are not stored in the HDD 105 and are only known to the user. In this case, the user manually inputs the measurement results from the input device 110, and the CPU 101 receives the input data, thereby acquiring them. Also, assume that the assist apparatus 100 has a network interface and can be connected to a network such as the Internet. In this case, the CPU 101 may receive the input data indicating the measurement results via the network, thereby acquiring them.

Figure 5B:
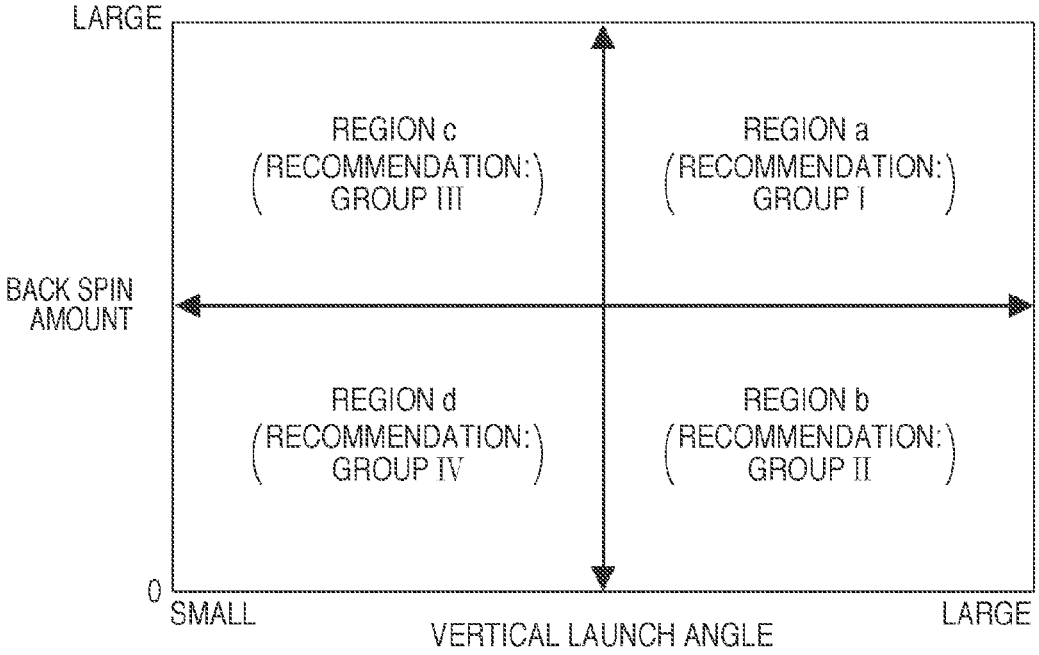
FIG. 5B is a diagram for explaining recommended shaft information.

In step S2, a recommended shaft is selected. This process is performed by referring in advance to recommended shaft information stored in the HDD 105, based on the measurement results acquired in step S1. FIG. 5B is a diagram for explaining the recommended shaft information.

The recommended shaft information indicates a correspondence between measurement parameters obtained upon a test strike using a golf club to which a reference shaft is attached, and recommended shafts among shafts of a plurality of types. In this embodiment, the recommended shaft information indicates a correspondence between the back spin amount and the vertical launch angle, and groups of recommended shafts, as will be described below.

As shown in FIG. 5B, the recommended shaft information has four regions a to d defined based on whether the back spin amount is relatively large or small and whether the vertical launch angle is relatively large or small. The threshold of the back spin amount is, for example, 2,000 to 3,000 rpm for a driver and preferably is about 2,500 rpm. Also, the threshold of the vertical launch angle is, for example, 12° to 16° for a driver and preferably is 14°.

The vertical launch angle serves as an index that determines the swing trajectory of the user who has made a test strike. In other words, this trajectory can be evaluated such that an upper blow swing trajectory is produced if the vertical launch angle is large, and a down blow swing trajectory is produced if the vertical launch angle is small. Also, the back spin amount serves as an index which determines whether the user who has made a test strike tends to largely turn his or her hands at the time of impact (tends to rotate the face). In other words, this tendency can be evaluated such that the user turns his or her hands little if the back spin amount is large, and the user largely turns his or her hands if the back spin amount is small.

The swing trajectory and the tendency to or not to largely turn hands, and the shaft rigidity distribution can be evaluated to have the following relationship. First, a user who produces an upper blow swing trajectory tends to be incapable of making the head travel at the time of impact upon delaying the head, that is, flexing the proximal side of the shaft because he or she cannot make a late hit upon a down swing. Hence, the use of a golf club having a shaft with a flexible proximal side allows this user to easily have a swing while making a late hit upon a down swing, so a shaft with a soft proximal end is suitable for him or her. Conversely, a user who produces a down blow swing trajectory tends to hit a ball while bouncing it with the head at the time of impact. Hence, the use of a golf club having a shaft with a tight proximal side allows this user to easily have a swing, so a shaft with a stiff proximal end is suitable for him or her.

A user who tends to largely turn his or her hands at the time of impact prefers that the face surface should rotate to follow a turn of his or her hands, and therefore prefers moderate head behaviors. Hence, a shaft with a stiff distal end is suitable for this user. Conversely, for a user who tends to turn his or her hands little at the time of impact, the head preferably travels at the time of impact. Hence, a shaft with a soft distal end is suitable for this user.

Referring to FIG. 5B, region a corresponds to both a relatively large vertical launch angle and back spin amount. Hence, a shaft with a stiff proximal end and a soft distal end is suitable for region a, so group I is associated with region a as recommended shafts. Region b corresponds to a relatively large vertical launch angle and a relatively small back spin amount. Hence, a shaft with both a stiff proximal end and distal end is suitable for region b, so group II is associated with region b as recommended shafts.

Region c corresponds to a relatively small vertical launch angle and a relatively large back spin amount. Hence, a shaft with both a soft proximal end and distal end is suitable for region c, so group III is associated with region c as recommended shafts. Region d corresponds to both a relatively small vertical launch angle and back spin amount. Hence, a shaft with a soft proximal end and a stiff distal end is suitable for region d, so group IV is associated with region d as recommended shafts.

In the process of step S2, the CPU 101 specifies one of regions a to d, to which the user belongs, from the measurement results of the vertical launch angle and back spin amount acquired in step S1. Next, the CPU 101 specifies a shaft group corresponding to the specified region among groups I to IV. Moreover, the CPU 101 specifies the flex of a shaft suitable for the user from the head speed acquired in step S1. For example, the CPU 101 specifies R if the head speed is less than 42 m/s, S if the head speed is 42 m/s (inclusive) to 47 m/s (exclusive), and X if the head speed is 47 m/s or more.

The CPU 101 selects a shaft, which belongs to the specified group and flex, as a recommended shaft by referring to the shaft classification information shown in FIG. 4B. For example, if group I and flex X are specified, two shafts "Astro75" and "TDR-70" are recommended shafts.

Although the group specification and the flex specification are performed in this order in this embodiment, they may be performed in reverse order. Also, although the recommended shaft information and the shaft classification information are separately stored in the HDD 105 in this embodiment, they may be combined into recommended shaft information.

Referring back to FIG. 5A, in step S3, the selection result is output. In this case, information indicating the recommended shaft selected in step S2 is output. The information indicating the recommended shaft is, for example, the name of this shaft, but can also include information on, for example, specifications of this shaft. In this embodiment, the information is output by displaying it on the display 120. Alternatively, the information may be output using a sound. Or again, if the assist apparatus 100 has a network interface and can be connected to a network such as the Internet, the information may be output by transmitting it to a computer of the user via the network.

In this manner, in this embodiment, shafts more suitable for individual golfers can be selected by selecting recommended shafts in consideration of the shaft rigidity distributions. Especially because the vertical launch angle and the back spin amount are associated with the shaft rigidity distribution, a shaft suitable for the swing trajectory of a golfer as the user and his or her habit in terms of face rotation at the time of impact can be recommended to him or her.

Second Embodiment

Figure 6:
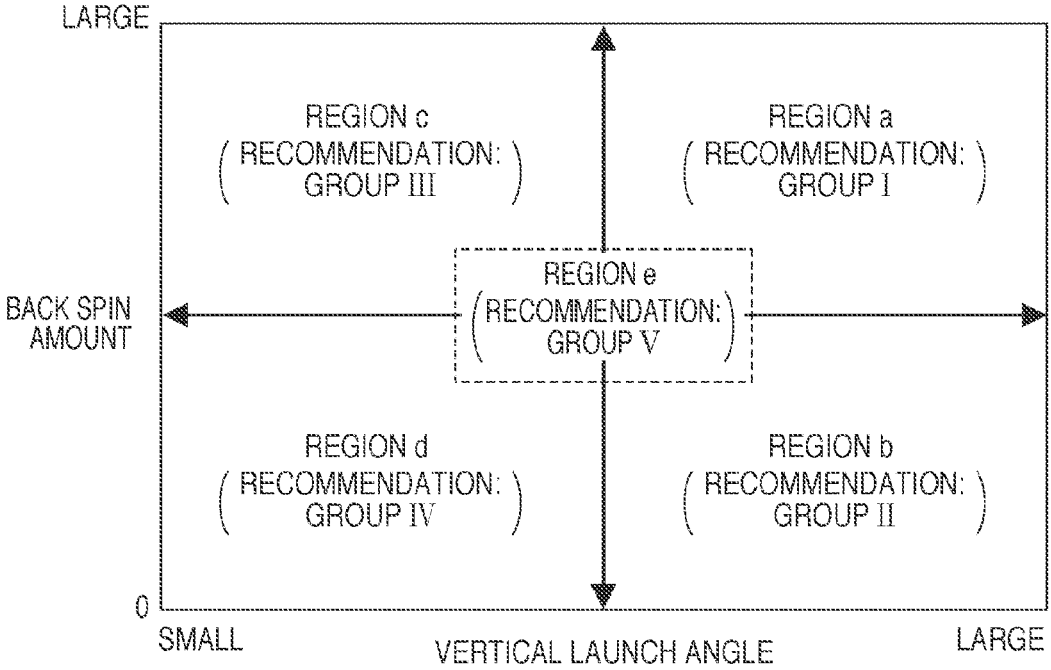
FIG. 6 is a diagram for explaining another recommended shaft information.

Although users are classified into four groups in accordance with the vertical launch angle and the back spin amount to generate the recommended shaft information in the first embodiment, they may be classified into five groups. FIG. 6 shows an example in which users are classified into five groups in accordance with the vertical launch angle and the back spin amount. In the example shown in FIG. 6, region e is added to the recommended shaft information shown in FIG. 5B. Region e is a specific range which defines the vertical launch angle and the back spin amount in advance.

Region e corresponds to, for example, a vertical launch angle of 12° (inclusive) to 16° (inclusive) and a back spin amount of 2,000 to 3,000 rpm for a driver, and preferably corresponds to an ideal range of the vertical launch angle of a struck ball and the back spin amount on this ball. In other words, users belonging to region e are more advanced golfers.

Figures 7A, 7B:
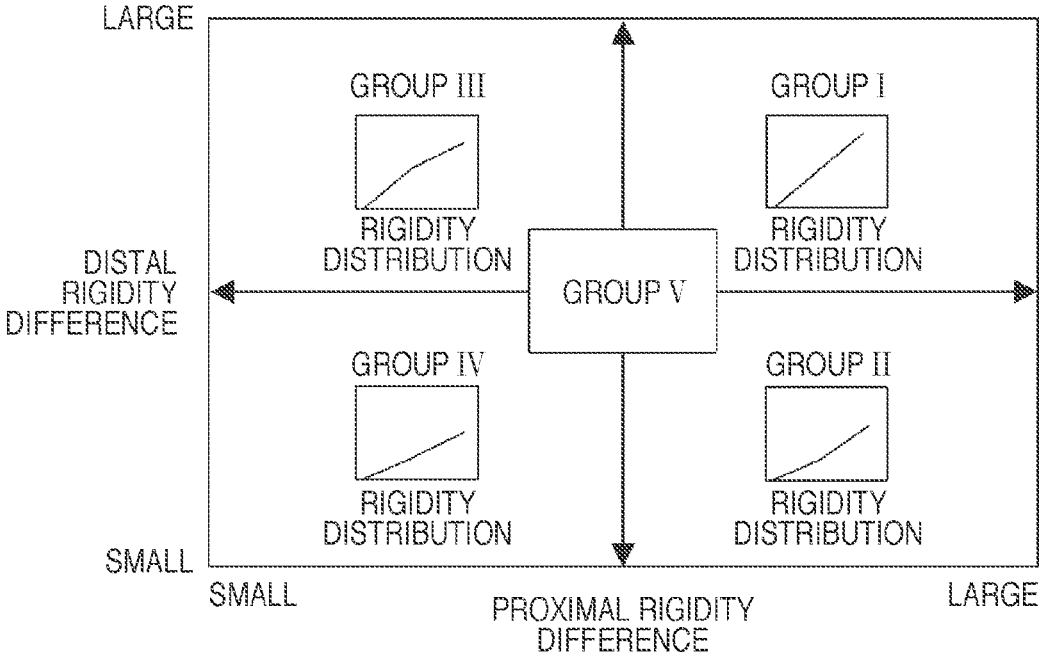
FIG. 7A is a diagram for explaining groups I to V.
FIG. 7B is a table showing an example of the types of shafts in each group.

When recommended shaft information is generated as shown in FIG. 6, shaft rigidity distributions must also be classified into five groups. FIG. 7A is a diagram for explaining groups I to V. FIG. 7B shows an example of shaft classification information. Groups I to IV in the second embodiment are the same as in the first embodiment. As shown in FIG. 7A, group V has its distal rigidity difference and proximal rigidity difference in intermediate numerical ranges. The arrangement of the shaft classification information in the second embodiment is the same as the first embodiment, except that in the former group V is added.

A process associated with recommended shaft selection when users and recommended shafts are each classified into five groups, as in this embodiment, is the same as in step S2 of FIG. 5A. This makes it possible to select shafts suitable for more advanced golfers. However, a scheme of recommending the recommended shafts in region e upon lowering their priority level can also be adopted. In other words, users are temporarily classified into four regions a to d, as shown in FIG. 5B, and shafts in a corresponding group among groups I to IV are determined as recommended shafts at the first priority level. Next, if the user belongs to region e, shafts belonging to group V are determined as recommended shafts at the second priority level.

Third Embodiment

A beginner golfer is likely to suffer variations in vertical launch angle and back spin amount, so his or her swing characteristics may not be formed from the beginning. Therefore, the recommended shaft selection according to the first and second embodiments may not always be suitable for that golfer. In view of this, users are divided into beginner golfers and intermediate/advanced golfers first, and the recommended shaft selection according to the first and second embodiments is executed for the intermediate/advanced golfers.

Figure 8:
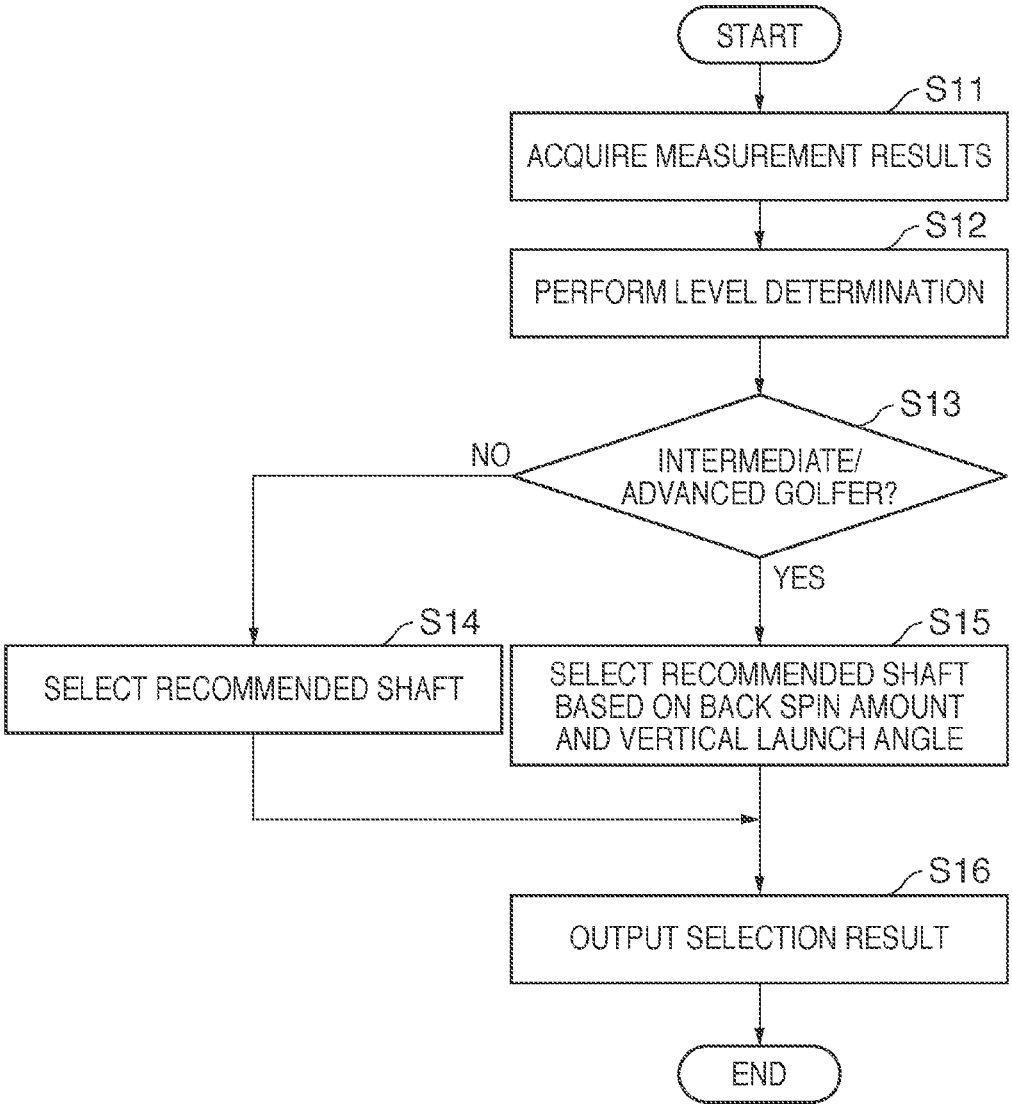
FIG. 8 is a flowchart showing another example of a selection assist process executed by a CPU 101.

FIG. 8 is a flowchart showing another example of a selection assist process executed by a CPU 101. In step S11, the measurement results of measurement parameters associated with a test strike are acquired. The process in step S11 is the same as in step S1 in the first embodiment. In step S12, the user level is determined based on the measurement results acquired in step S11. A beginner golfer generally strikes a ball with a large horizontal shake. In view of this, in this embodiment, the user levels are classified in accordance with the horizontal launch angle and the side spin amount.

Figure 9:
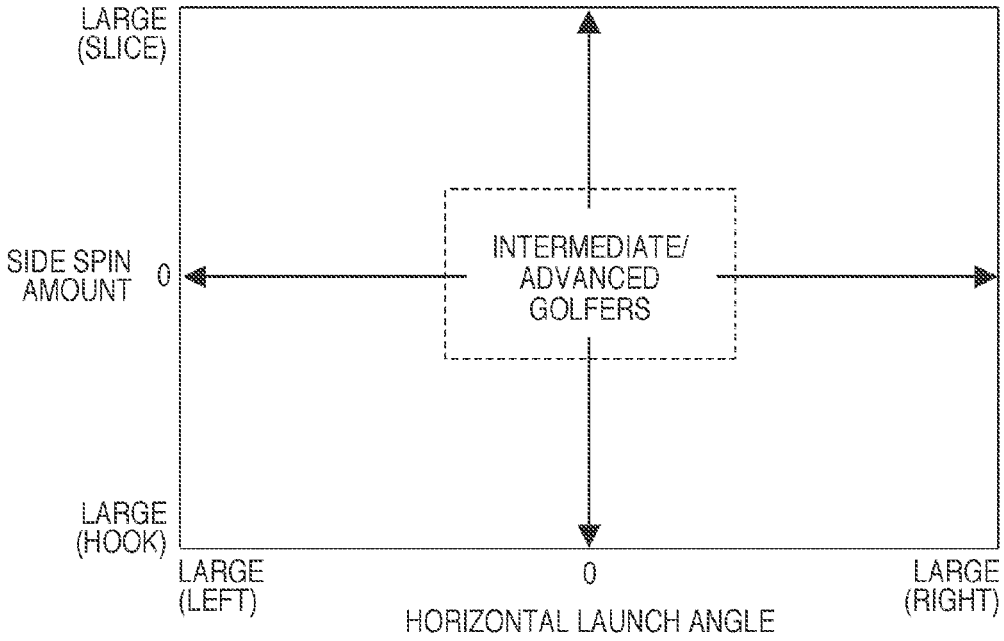
FIG. 9 is a diagram for explaining level determination.

FIG. 9 is a diagram for explaining level determination. Users corresponding to a region surrounded by a broken line are determined as intermediate/advanced golfers, and those corresponding to the remaining region are determined as beginner golfers. The region in which users are determined as intermediate/advanced golfers is a specific range which defines the horizontal launch angle and the side spin amount in advance. For example, this range has a horizontal launch angle of 5° or less in both the rightward and leftward directions, and a side spin amount of 1,000 rpm or less upon both a slice and a hook. Note that the side spin direction (a slice or a hook) is defined with reference to a right-handed golfer.

Referring back to FIG. 8, it is determined in step S13 whether the user who has made a test strike is classified into intermediate/advanced golfers (whether the horizontal launch angle and the side spin amount fall within the specific range). If YES in step S13, this user is determined as an intermediate/advanced golfer, and the process advances to step S15. If NO in step S13, the process advances to step S14.

In step S14, a shaft suitable for the user determined as a beginner golfer is selected. In this case, for example, the flex of a shaft suitable for the user is specified by focusing attention on his or her head speed, and a shaft with the specified flex is selected as a recommended shaft. If a flex suitable for the user is specified as, for example, R, shafts "Astro55", "TourB08", "EW-5", "MC-5", "BararaH53", "N55", "5Y07", and "5V08" are recommended shafts for him or her in the example shown in FIG. 4B.

In step S15, a recommended shaft is selected by the same process (the process in step S2 of FIG. 5) as in the first and second embodiments. In step S16, the selection result is output. In this case, information indicating the recommended shaft selected in step S14 or S15 is output. The process in step S16 is the same as in step S3 of the first embodiment.

In this manner, in this embodiment, a recommended shaft corresponding to the user level can be selected by changing a recommended shaft selection method in accordance with this level.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-293805, filed Dec. 25, 2009, which is hereby incorporated by reference herein in its entirety.

What is claimed is:

1. A shaft selection assist apparatus comprising:

storage means for storing recommended shaft information indicating a correspondence between measurement parameters obtained upon a test strike with a golf club to which a predetermined reference shaft is attached, and recommended shafts among shafts of a plurality of types;

acquisition means for acquiring measurement results of the measurement parameters associated with a test strike actually made by a user with the golf club;

selection means for selecting a recommended shaft by referring to the recommended shaft information based on the measurement results acquired by said acquisition means; and output means for outputting information indicating the recommended shaft selected by said selection means, wherein the measurement parameters include a vertical launch angle of a struck ball and a back spin amount on the struck ball, the recommended shaft information stored in said storage means comprises information which specifies recommended shafts based on a relationship between a shaft rigidity distribution, and the vertical launch angle and the back spin amount, and the recommended shaft information stored in said storage means specifies as recommended shafts a shaft which has a small rigidity difference on a proximal side if the vertical launch angle is relatively large, a shaft which has a large rigidity difference on the proximal side if the vertical launch angle is relatively small, a shaft which has a large rigidity difference on a distal side if the back spin amount is relatively large, and a shaft which has a small rigidity difference on the distal side if the back spin amount is relatively small.

2. The apparatus according to claim 1, wherein the recommended shaft information stored in said storage means comprises information which specifies recommended shafts based on a relationship between a rigidity difference in a predetermined range on a proximal side of a shaft and a rigidity difference in a predetermined range on a distal side of the shaft, and the vertical launch angle and the back spin amount.

3. The apparatus according to claim 1, wherein the measurement parameters further include a horizontal launch angle of the struck ball, and a side spin amount on the struck ball, and said selection means selects a recommended shaft by referring to the recommended shaft information based on the measurement results of the vertical launch angle and the back spin amount if the horizontal launch angle and the side spin amount among the measurement results acquired by said acquisition means fall within a specific range determined in advance.

4. A shaft selection assist apparatus comprising:

a storage unit that stores recommended shaft information indicating a correspondence between measurement parameters obtained upon a test strike with a golf club to which a predetermined reference shaft is attached, and recommended shafts among shafts of a plurality of types;

an acquiring unit that acquires measurement results of the measurement parameters associated with a test strike actually made by a user with the golf club;

a selecting unit that selects a recommended shaft by referring to the recommended shaft information based on the measurement results acquired by said acquiring unit; and an output unit that outputs information indicating the recommended shaft selected by said selecting unit, wherein the measurement parameters include a vertical launch angle of a struck ball and a back spin amount on the struck ball, the recommended shaft information stored in said storage unit comprises information which specifies recommended shafts based on a relationship between a shaft rigidity distribution, and the vertical launch angle and the back spin amount, and the recommended shaft information stored in said storage unit specifies as recommended shafts a shaft which has a small rigidity difference on a proximal side if the vertical launch angle is relatively large, a shaft which has a large rigidity difference on the proximal side if the vertical launch angle is relatively small, a shaft which has a large rigidity difference on a distal side if the back spin amount is relatively large, and a shaft which has a small rigidity difference on the distal side if the back spin amount is relatively small.

* * * * *